United States Patent [19]

Shields

[11] Patent Number: 4,979,778

[45] Date of Patent: Dec. 25, 1990

[54] SYNCHROTILT CHAIR

[75] Inventor: Michael R. Shields, Greensboro, N.C.

[73] Assignee: Brayton International, Inc., High Point, N.C.

[21] Appl. No.: 298,051

[22] Filed: Jan. 17, 1989

[51] Int. Cl.[5] ..... A47C 3/00

[52] U.S. Cl. ..... 297/301; 297/300

[58] Field of Search ..... 297/300, 301, 304, 322

[56] References Cited

U.S. PATENT DOCUMENTS

| | | | |
|---|---|---|---|
| 488,773 | 4/1892 | Peck . | |
| 581,986 | 5/1897 | Gould . | |
| 626,521 | 6/1899 | Benjamin . | |
| 1,274,277 | 7/1918 | Kiesele . | |
| 2,321,385 | 6/1943 | Herold . | |
| 2,365,200 | 12/1944 | Lorenz . | |
| 2,612,211 | 9/1952 | Gielow et al. . | |
| 2,615,496 | 10/1952 | Lorenz et al. . | |
| 2,690,786 | 10/1954 | Sedlock . | |
| 2,730,164 | 1/1956 | Higley et al. . | |
| 3,913,975 | 6/1975 | Carter . | |
| 4,009,856 | 3/1977 | Wolters et al. . | |
| 4,143,910 | 3/1979 | Geffers et al. . | |
| 4,270,797 | 6/1981 | Brauning . | |
| 4,411,469 | 10/1983 | Drabert et al. . | |
| 4,438,898 | 3/1984 | Knoblauch et al. . | |
| 4,461,511 | 7/1984 | Berneking et al. . | |
| 4,479,679 | 10/1984 | Fries et al. . | |
| 4,494,795 | 1/1985 | Roossien et al. . | |
| 4,498,702 | 2/1985 | Raftery . | |
| 4,518,201 | 3/1985 | Wahlmann et al. . | |
| 4,537,445 | 8/1985 | Neuhoff . | |
| 4,575,150 | 3/1986 | Smith . | |
| 4,595,236 | 6/1986 | Rizzoli . | |
| 4,640,548 | 1/1987 | Desanta . | |
| 4,641,885 | 2/1987 | Brauning . | |
| 4,652,050 | 3/1987 | Stevens | 297/300 |
| 4,653,806 | 3/1987 | Willi . | |
| 4,668,012 | 5/1987 | Locher . | |
| 4,682,814 | 7/1987 | Hansen . | |
| 4,685,730 | 8/1987 | Linguanotto . | |
| 4,695,093 | 9/1987 | Suhr et al. . | |
| 4,707,028 | 11/1987 | Gamberini . | |
| 4,709,962 | 12/1987 | Steinmann . | |
| 4,732,424 | 3/1988 | Uredat-Neuhoff . | |
| 4,758,045 | 7/1988 | Edel et al. | 297/300 |
| 4,773,706 | 9/1988 | Hinrichs | 297/300 |
| 4,776,633 | 10/1988 | Knoblock et al. | 297/300 |

FOREIGN PATENT DOCUMENTS

| | | |
|---|---|---|
| 2757349 | 7/1979 | Fed. Rep. of Germany . |
| 3537203 | 4/1986 | Fed. Rep. of Germany . |
| 820791 | 8/1937 | France . |
| 9714 | 4/1914 | United Kingdom . |
| 1165135 | 9/1969 | United Kingdom . |

*Primary Examiner*—Laurie K. Cranmer

*Attorney, Agent, or Firm*—Price, Heneveld, Cooper, DeWitt & Litton

[57] ABSTRACT

A chair includes a support base, a back and a seat. A tilt mechanism connects the back to the base permitting the back to move from an upright position to a reclined position. A forward portion of the seat is connected to the base through a double pivot. A rearward portion of the seat is connected to the back through a single pivot. As the back tilts to its reclined position, the rearward portion of the seat moves rearwardly and downwardly and the forward portion of the seat moves rearwardly and downwardly lowering overall seat height and eliminating leg lift.

19 Claims, 2 Drawing Sheets

SYNCHROTILT CHAIR

BACKGROUND OF THE INVENTION

The present invention relates to chair controls or tilt mechanisms and more particularly to a chair including provision for synchronizing the tilting of a seat and a back.

Various forms of tilt mechanisms for office chairs and the like have heretofore been proposed. Generally, such mechanisms permit the chair to tilt or recline rearwardly with respect to a base or support pedestal. In one form, a separate back tilts with respect to a base while the seat portion remains in a fixed position. In another form, the seat and back are formed as an integral or rigidly connected unit. The seat and back tilt together in unison through the same arc with the forward portion of the seat being raised. In other forms of chairs, the seat and back are separate members. They are interconnected, however, so that their tiling action is synchronized with the back tilting through an angle greater than that of the seat. Examples of prior tilting mechanisms may be found in commonly owned U.S. Pat. No. 4,776,633, entitled INTEGRATED CHAIR AND CONTROL and issued on Oct. 11, 1988 to Knoblock et al; U.S. Pat. No. 4,494,795, entitled VARIABLE BACK ADJUSTER FOR CHAIRS and issued on Jan. 22, 1985 to Roossein et al; U.S. Pat. No. 4,479,679, entitled BODY WEIGHT CHAIR CONTROL and issued on Oct. 30, 1984 to Fries et al; and U.S. Pat. No. 4,438,898 entitled CHAIR CONTROL LOCKING MECHANISM and issued on Mar. 27, 1984 to Knoblauch et al.

U.S. Pat. No. 4,575,150 entitled SUSPENSION ARRANGEMENT FOR A TILTING CHAIR and issued on Mar. 11, 1986 to Smith discloses a task chair having a tilt action between a seat and a back. A back support is pivotally attached by a helical coil spring to a stationary support or base. The seat is attached to the base by a forward pair of helical springs and to the back support by a rearward pair of helical springs. Pivot pins or pivot supports are omitted and the back and seat are interconnected to each other and the base solely by springs.

With prior tilt mechanisms, as the chair is reclined, pressure is applied &:o the underside of the user's thighs. The forward lip of the chair is raised, thereby lifting the user's legs. This lifting action can result in muscular discomfort and circulation problems. On approach to eliminating leg lift is disclosed in commonly owned U.S. Pat. No. 4,498,702, entitled SEATING UNIT WITH FRONT FLEX AREA and issued on Feb. 12, 1985 to Raftery et al. As disclosed therein, the chair includes a forward lip or thigh support area which is attached to the seat by leaf springs. When the chair is tilted, the articulated seat forward area will flex downwardly to limit leg lift.

A need exists for a unique synchronized chair tilting or control mechanism which will eliminate leg lift, reduce compression of the thighs and automatically adjust to the anatomical requirements of the user.

SUMMARY OF THE INVENTION

In accordance with the present invention, an improved chair control mechanism is provided whereby the aforementioned needs are fulfilled. Essentially, the mechanism includes a support base or pedestal and means for pivotally mounting a back to the base for tilting movement from an upright position to a reclined position. A separate seat is interconnected with the back and the base so that the rear portion of the seat maY track or follow the movement of the back in a descending arc. Provision is made for causing the front edge of the seat to follow the downward and rearward motion of the rear edge at a proportional rate with the front edge being lowered when reclining. The mechanism permits the chair to adjust naturally to the actions of the user eliminating leg lift and reducing compression of the thighs.

DETAILED DESCRIPTION OF THE PREFERRED EMBODIMENT

Figure 1:
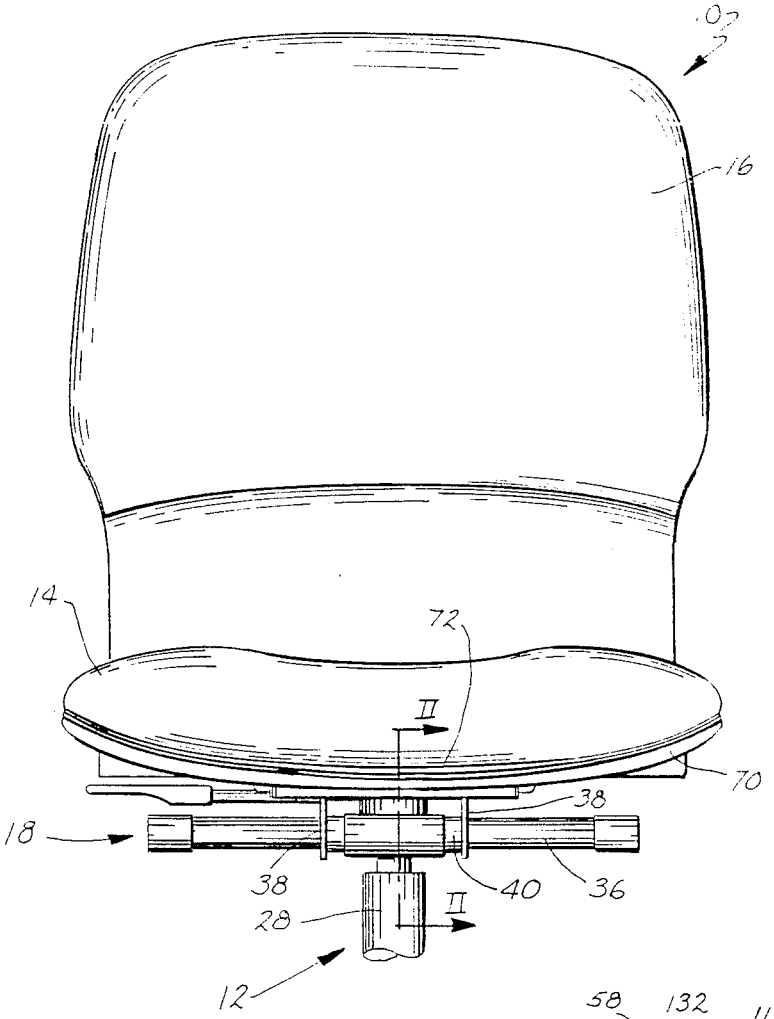
FIG. 1 is a front view of a chair in accordance with the present invention.
Figure 3:
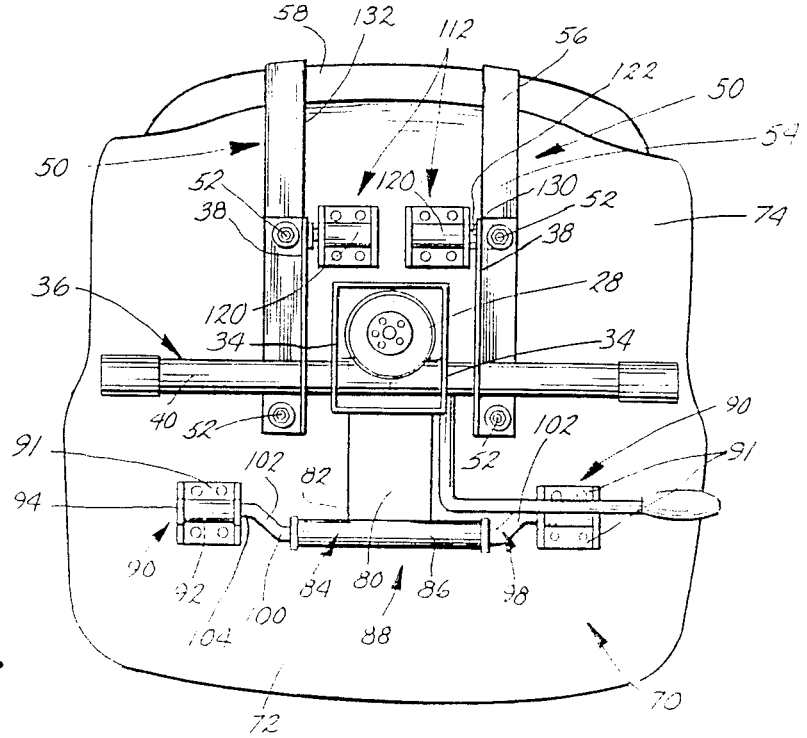
FIG. 3 is a bottom view taken generally along line III—III of FIG. 2.
Figure 2:
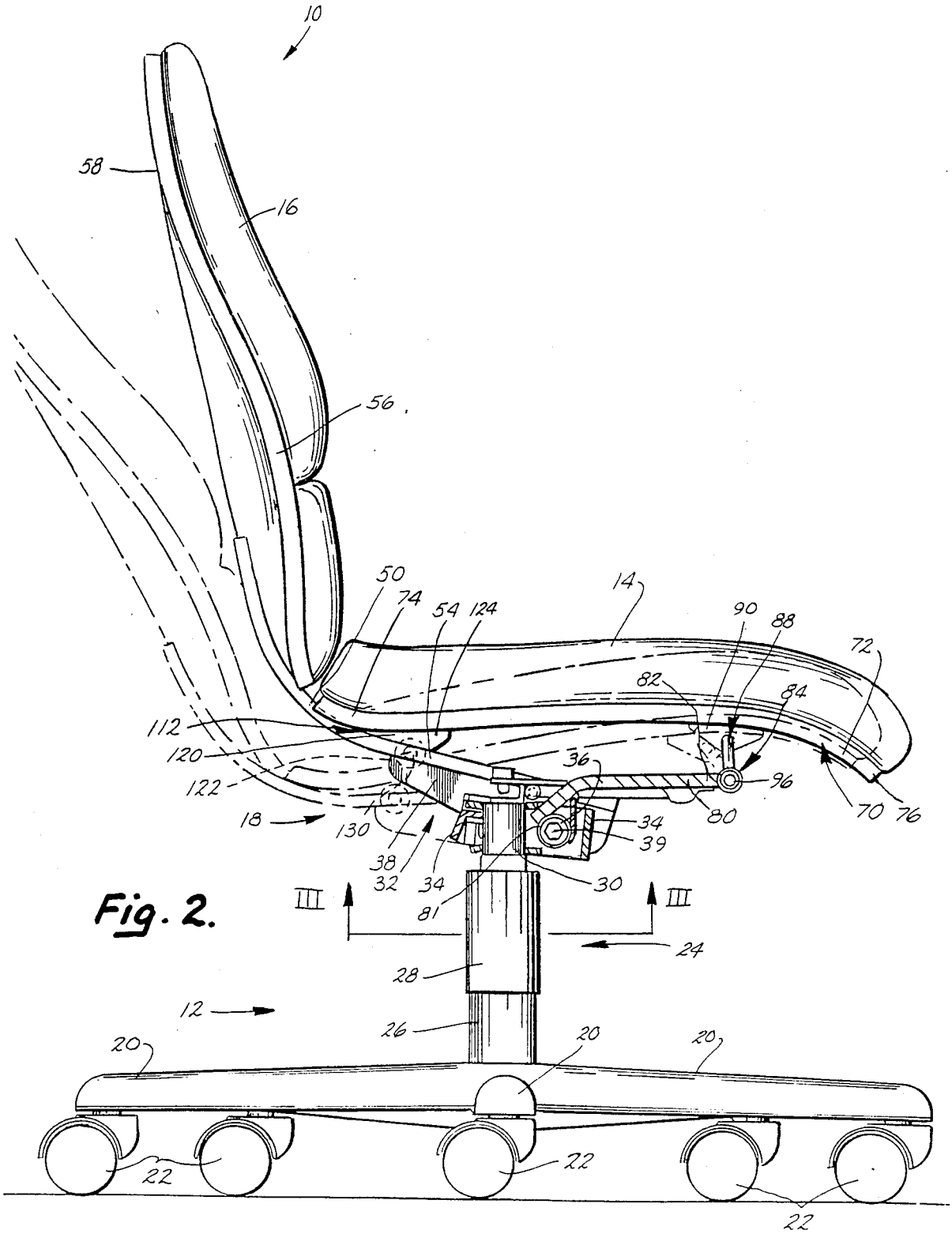
FIG. 2 is a cross sectional taken generally along line II—II of FIG. 2.

A chair in accordance with the preferred embodiment of the present invention is illustrated in FIGS. 1–3 and generally designated by the numeral 10. Chair 10 includes a base 12, a seat 14, a back 16 and a chair control mechanism generally designated by the numeral 18. In a conventional fashion, base 12 may include a plurality of arms 20 supported on castors 22 (FIG. 2). A pedestal assembly 24 is fixed to arms 20. Pedestal assembly 24 includes a lower member 26 and an upper telescoping member 28. In a conventional fashion, members 26 and 28 are interconnected to provide height adjustment. A gas spring height adjuster or a threaded mechanism may be used.

A top 30 of pedestal assembly 24 supports chair control 18. Chair control 18 includes a tilt mechanism 32. Mechanism 32, as best seen in FIGS. 2 and 3, includes members 34, a hex bar torsion spring assembly 36 and spaced, parallel tilt plates or tilt brackets 38. Hex bar torsion spring assembly 36 and plates 38 are conventional items. In a known fashion, plates 38 are fixed to an outer tube 40 of the hex bar torsion spring assembly 36. Hex bar torsion spring assembly 36 biases tilt plates 38 to an upright position, as shown in solid lines in FIG. 2. Plates 38 pivot or tilt about a centerline 39 of assembly 36.

A pair of back support members or elongated bars 50 are fixed to plates 38. As shown in FIG. 3, support members 50 may be bolted to plates 38 by suitable fasteners 52. Support members 50 include a forward portion 54 and an upwardly angled rearward portion 56. A seat back 58 is fixedly secured to portions 56. As a result, back 58 is mounted on base 12 for rearward tilting action against the bias of hex bar torsion spring assembly 36.

In accordance with the present invention, a unique mechanism is provided for interconnecting seat portion 14 to base 12 and seat back 16. As best seen in FIGS. 2 and 3, seat 14 includes a lower pan 70. Pan 70 includes a forward portion 72 and a rearward portion 74. Forward portion 72 includes a downwardly turned forward lip or edge 76. Rearward portion 74 of the seat is configured and positioned to contact and support at least a portion of the buttock area of an adult user. Forward portion 72 and lip 76 are positioned to contact at least a portion of the thigh area of the user.

An elongated, fixed support plate 80 is welded to base members 34 and a central, nonmoving portion 81 of assembly 36. Support plate 80 is, therefore, fixed with respect to base 12. When the seat back tilts rearwardly, member 80 stays in its fixed, substantially horizontal position. A forward end 82 of support plate 80 defines a bearing or pivot assembly 84. Pivot assembly 84 includes a tubular housing 86. Housing 86 is fixed to end 82 and extends transversely to member 80. Forward portion 72 of seat 70 is connected to support member 80 through a double pivot link assembly 88. The link assembly includes a pair of spaced pivot or bearing assemblies 90. Each bearing assembly 90 includes attachment ears 91 and a journal housing 92 within which a bushing 94 may be disposed. Assembly 90 is preferably fabricated as a one-piece member from a suitable, self-lubricating material such as that sold under the brand name Delrin. Due to the lubricity and strength properties, a separate bushing need not be used with such a material. A bushing 96 is disposed within pivot housing 86. A rigid link 98 interconnects the seat with the base. Link 98 is generally U-shaped, as seen in FIG. 3. Link 98 includes an elongated base portion 100 received by bushing 96 and legs 102. Each leg 102 terminates in end portions 104. Portions 104 are rotatably received within pivot assemblies 90 by bushings 94. As a result, forward portion 72 of the seat is pivotally connected to the base by a rigid link at a fixed pivot point defined by assembly 84 and a movable pivot point defined by pivot assemblies 90.

Rearward portion 74 of seat 14 is pivotally attached to the back through support members 56. As seen in FIGS. 2 and 3, a pair of fixed rear links 112 are provided. Each rear link includes a pivot or journal housing 120 supporting a pivot pin 122. Housing 120 includes mounting ears 124. Ears 124 are fixed to the undersurface of rear portion 74 of seat 14. As a result, pivot pin 122 has an axis which is spaced from the lower surface of the rear portion 74 of seat 14. The assemblies define, in effect, a rigid link having an end fixed to the seat and an opposite end defined by pivot pin 122. Pivot pin 122 is disposed within a pivot bore, point or aperture 130 which opens through an inner surface 132 of each back support bar 50. As a result, rear portion 74 of seat 14 is pivoted to back 16.

The operation of the chair is illustrated in FIG. 2. With the chair in an initial upright position, as shown in solid lines, the user may recline the chair to a fully reclined position illustrated in dotted lines. As the chair moves from the upright to the reclined position, rearward portion 74 of the seat follows the rotational movement of the chair back since it is pivotally connected to back supports 50. The rear portion of the seat will move downwardly and rearwardly. Due to the pivotal connection of the rear portion of the seat and the double pivot connection of the forward portion of the seat, however, the forward portion moves rearwardly and downwardly. The front lip 76 of seat 14 is lowered as it moves rearwardly, thereby reducing seat height from the upright position. The pivotal interconnection eliminates leg lift and minimizes or eliminates compression of the undersurface of the user's thighs. Muscular discomfort and possible circulation problems due to compression and the leg lift are reduced or eliminated.

Prior mechanisms generally raised the forward lip of the seat even though the seat might move through an angle less than the tilt angle of the back. Such undesirable action is eliminated by the present invention. It is no longer necessary to articulate or form the seat in multiple pieces. With the present invention, movement of the chair back and seat during the tilting action is coordinated and synchronized to adapt to the user's anatomical requirements. The mechanism which lowers the front edge of the seat as it moves rearwardly causes the chair to adapt or adjust naturally to the action of the users. The chair and unique control mechanism, therefore, maximize comfort and use. The arrangement employs multiple rigid links including the seat pan, rear link 120, double pivot forward link 102, a fixed link or support 80 and the joined back support members and tilt plates 38. Seat 14 is pivotally connected to the back 16 at its rear portion and pivotally connected to base 12 at its forward portion. The double pivot at the forward portion causes the lip of the seat to move rearwardly and downwardly during reclining action. Overall seat height is, therefore, actually lowered in use.

In view of the foregoing description, those of ordinary skill in the art will undoubtedly envision various modifications which would not depart from the inventive concepts disclosed herein. For example, the castor base 12 could be replaced with a sled base. Other known tilt mechanisms could replace the tilt plates 38 and hex bar torsion spring. The synchrotilt mechanism of the present invention may be incorporated into any chair control which permits a chair back to be tilted against the resilient bias of a spring with respect to a base or support. The above description should, therefore, be considered as only that of the preferred embodiment. The true spirit and scope of the present invention may be determined by reference to the appended claims.

The embodiments of the invention in which an exclusive property or privilege is claimed are defined as follows:

1. A chair, comprising:

a support base having a pedestal and defining a forward fixed pivot portion;

a back;

tilt means connecting said back and said base for pivotally mounting said back to said base to permit rearward tilting of said back with respect to said fixed support base;

a seat having a forward portion and a rearward portion;

front pivot means between said seat and said base and pivotally connected to said seat and said base for permitting rearward and downward movement only of said seat forward portion upon rearward tilting of said back, said front pivot means including a forward link having an end pivoted to a fixed point on said seat and another end pivoted to a fixed point on said base pivot portion; and rear pivot means between said tilt means and said seat for pivotally connecting said rearward portion of said seat directly to said back for downward and rearward movement only upon rearward tilting of said back with respect to said base so that the forward portion of the seat follows the downward and rearward motion of the rear of the seat to reduce thigh compression and lower overall seat height.

2. A chair as defined by claim 1 wherein said tilt means comprises:

a bracket, said back being attached to said bracket;

back pivot means for pivoting said bracket to said base; and spring means engaging said bracket for biasing said bracket to a forward position.

3. A chair, comprising:
a support base;
a back;
tilt means connecting said back and said base for pivotally mounting said back to said base to permit rearward tilting of said back with respect to said fixed support base;
a seat having a forward portion and a rearward portion;
front pivot means between said seat and said base and pivotally connected to said seat and said base for permitting rearward and downward movement only of said seat forward portion upon rearward tilting of said back said front pivot means including a forward link pivoted to a fixed point on said seat and a fixed point on said base; and
rear pivot means between said tilt means and said seat for pivotally connecting said rearward portion of said seat for downward and rearward movement only upon rearward tilting of said back with respect to said base so that the forward portion of the seat follows the downward and rearward motion of the rear of the seat to reduce thigh compression and lower overall seat height, said tilt means comprising;
a bracket, said back being attached to said bracket;
back pivot means for pivoting said bracket to said base; and
spring means engaging said bracket for biasing said bracket to a forward position, said forward link of said front pivot means is pivoted at one end to the forward portion of said seat and at an opposite end to said base, and
wherein said rear pivot means comprises:
a rear link having an end rigidly fixed to said rearward portion of said seat, said rear link extending downwardly from said seat and having an opposite end pivoted to said bracket of said tilt means.

4. A chair as defined by claim 3 wherein said support base comprises:
a pedestal; and
a forward, fixed pivot bracket extending from said pedestal, said opposite end of said forward link being pivoted to said forward pivot bracket.

5. A chair as defined by claim 4 wherein said forward link comprises an elongated, generally U-shaped bar having a base pivoted to said forward pivot bracket and a pair of spaced legs, each leg being pivoted to said forward portion of said seat.

6. A chair as defined by claim 5 wherein said bracket of said tilt means includes an elongated bar having a forward portion attached to said back pivot means and an upwardly angled rearward portion attached to said back.

7. A chair as defined by claim 6 wherein said rear link comprises:
a housing;
a bushing disposed within said housing; and
a pin extending from said bushing and engaging said bracket.

8. A chair, comprising:
a base;
a back;
tilt means for mounting said back on said base to permit rearward tilting of said back between a fully upright position and a fully rearward position said tilt means including a back support member fixed to said back;
a one-piece seat having a rearward portion thereof positioned to contact at least a portion of a buttock area of an adult user, and a forward portion thereof positioned to contact at least a portion of a thigh area of an adult user;
rearward link means having an end rigidly fixed to said rearward portion of said seat and extending downwardly therefrom to an opposite end for pivotally connecting the rearward portion of said seat with said back support member at said opposite end of said rearward link means to support the rearward portion of said seat on said back support member in a manner such that when said back is tilted rearwardly from the fully upright position, the rearward portion of said seat moves only rearwardly and downwardly; and
forward link means between a fixed point on said seat and a fixed point on said base for pivotally connecting the forward portion of said seat with said base and for permitting the forward portion of said seat to move only rearwardly and downwardly when said back is tilted rearwardly from the fully upright position to lower overall seat height and to alleviate undesirable pressure at the thigh area of the user.

9. A chair as defined by claim 8 wherein said forward link means comprises:
a fixed pivot housing mounted on said base;
a rigid link having an end pivoted to said fixed pivot housing; and
a seat pivot housing secured to said seat forward portion, said rigid link including another end pivoted to said seat pivot housing.

10. A chair as defined by claim 9 wherein said fixed pivot housing comprises an elongated tube and a bushing disposed within said tube, said an end of said link being received by said bushing.

11. A chair as defined by claim 10 wherein said rearward link means comprises a journal housing fixed to said seat to define a rear link and a pivot pin journaled within said journal housing, said back defining a pivot point receiving said pivot pin.

12. A chair as defined by claim 11 wherein said back support member includes an elongated support bar, said bar including a forward portion fixed to said tilt means and an upwardly angled rearward portion, said forward portion of said support bar defining said pivot point.

13. A chair as defined by claim 9 wherein said rearward link means comprises a journal housing fixed to said seat to define a rear link and a pivot pin journaled within said journal housing, said back support member defining a pivot point receiving said pivot pin.

14. A chair as defined by claim 8 wherein said rearward link means comprises a journal housing fixed to said seat to define a rear link and a pivot pin journaled within said journal housing, said back support member defining a pivot point receiving said pivot pin.

15. A control mechanism for a chair of the type having a seat separate from a back, said control mechanism including:
a fixed support base;
a tilt plate adapted to be pivotally mounted on said base;
resilient means connecting said tilt plate to said base for resiliently biasing said plate from a reclined, tilt position to an upright position;
a fixed pivot assembly secured to siad base;

a seat pivot assembly adapted to be fixed to a forward portion of a seat;

a rigid link having a portion pivoted to said fixed pivot assembly and an end pivoted at a fixed point to said seat pivot assembly for pivotal movement only;

a back support fixed to said tilt plate; and a rear seat link having an end rigidly fixed to a rear portion of the seat and an opposite end pivoted to said back support, said links being configured so that seat height is lowered as the chair moved from an upright position to a reclined position.

16. A control mechanism as defined by claim 15 wherein said fixed pivot assembly includes an elongated plate fixed to said base and a tube defining a pivot housing fixed to said plate, said rigid link portion being rotatably supported within said pivot housing.

17. A control mechanism as defined by claim 16 wherein said rigid link is a generally U-shaped, elongated rod having a base portion journaled within said pivot housing and a pair of legs, one of said legs being received by said seat pivot assembly and the other of said legs being received by another seat pivot assembly.

18. A control mechanism as defined by claim 17 wherein said rear seat link includes a rear journal housing and a rear pivot pin connecting said rear journal housing to said back support.

19. A control mechanism as defined by claim 15 wherein said rear seat link includes a rear journal housing and a rear pivot pin connecting said rear journal housing to said back support.

* * * * *

UNITED STATES PATENT AND TRADEMARK OFFICE

CERTIFICATE OF CORRECTION

PATENT NO. : 4,979,778

DATED : December 25, 1990

INVENTOR(S) : Michael R. Shields

It is certified that error appears in the above-identified patent and that said Letters Patent is hereby corrected as shown below:

Column 1, line 45;

"&:o" should be --to--.

Column 1, line 48;

"On" should be --One--.

Column 2, line 2;

"maY" should be --may--.

Column 6, claim 15, line 68;

"siad" should be --said--.

Column 6, claim 15, line ;

"moved" should be --moves--.

Signed and Sealed this

Eleventh Day of August, 1992

*Attest:*

DOUGLAS B. COMER

*Attesting Officer*

*Acting Commissioner of Patents and Trademarks*